United States Patent [19]

Augustine et al.

[11] 4,398,364

[45] Aug. 16, 1983

[54] STEAM IRON

[75] Inventors: Robert J. Augustine, Downers Grove; James C. Mysicka, Berwyn, both of Ill.

[73] Assignee: Sunbeam Corporation, Chicago, Ill.

[21] Appl. No.: 283,258

[22] Filed: Jul. 14, 1981

[51] Int. Cl.[3] ..... D06F 75/18

[52] U.S. Cl. ..... 38/77.5

[58] Field of Search ..... 38/77.5, 77.7, 77.8, 38/90, 77.81, 77.82

[56] References Cited

U.S. PATENT DOCUMENTS

| | | | |
|---|---|---|---|
| 2,230,815 | 2/1941 | Sebo | 38/77.8 |
| 4,104,815 | 8/1978 | Hammer | 38/77.5 |
| 4,170,835 | 10/1979 | Bain, Jr. | 38/77.5 |

FOREIGN PATENT DOCUMENTS

| | | | |
|---|---|---|---|
| 2442126 | 3/1975 | Fed. Rep. of Germany | 38/77.5 |

*Primary Examiner*—Werner H. Schroeder
*Assistant Examiner*—Andrew M. Falik
*Attorney, Agent, or Firm*—George R. Clark; Neil M. Rose; Clifford A. Dean

[57] ABSTRACT

A lightweight pressing and steaming iron having a soleplate with a heating element and steam passages in communication with steam ports including a first plastic housing member mounted on the soleplate and defining the bottom wall of a water reservoir and a second plastic housing member disposed over and secured to the first plastic housing member by a suitable sealant and defining the top and side walls of the water reservoir. The second plastic housing member also defines a tower-like structure at the forward end of the iron and a handle projecting rearwardly from the upper end of the tower-like structure. A valve located between the water reservoir and the soleplate steam passages includes an orifice adapted, when the valve is open, to provide a predetermined flow of water from the reservoir to the steam passages for normal steam ironing. First and second bellows pumps are provided in the upper part of the tower-like structure in side by side relationship with their actuating portions projecting upwardly through the handle and a spray nozzle is located on the front of the tower-like structure, the outlet port of the first bellows pump being connected to the spray nozzle, the outlet port of the second bellows pump being connected to the steam passages in the soleplate, and the inlet ports of both bellows pumps having inlet tubes extending into the lower rear portion of the reservoir.

11 Claims, 5 Drawing Figures

STEAM IRON

BACKGROUND OF THE INVENTION

This invention relates generally to pressing irons and more specifically to lightweight irons having spray and instant extra steam features.

Although lightweight irons have recently become available to the ironing public, none of same are known to provide spray and instant extra steam features wherein the controls for these features are conveniently located at the front of the handle for ready thumb actuation by one ironing without the necessity of releasing or changing one's grip on the iron.

SUMMARY OF THE INVENTION

The present invention is directed to lightweight irons having spray and/or instant extra steam features in addition to a normal steaming function, both of which features are usable in both the horizontal and vertical positions of the iron whereby same may be used not only for the more ordinary ironing tasks but also for ironing hanging fabrics such as curtains and drapes with both the spray and instant extra steam features being available for these more unusual ironing jobs. For maximum convenience, the spray and instant extra steam controls are located on the handle at the forward end thereof for ready thumb actuation without releasing or changing one's grip on the iron handle.

DETAILED DESCRIPTION OF THE INVENTION

Figure 1:
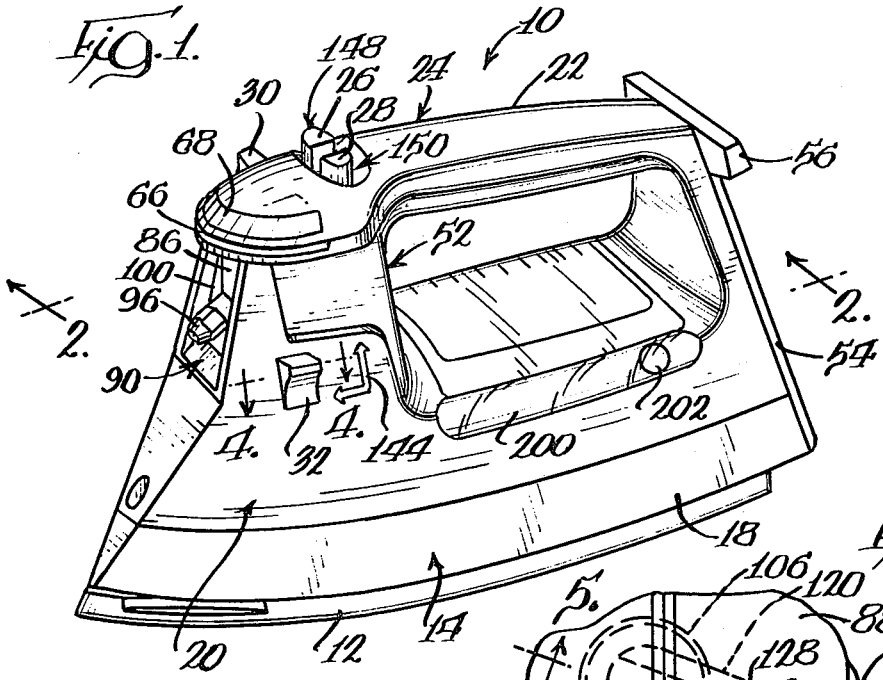
FIG. 1 is a perspective view of a pressing iron embodying the invention.

As illustrated in FIG. 1, a lightweight pressing iron 10 embodying the invention is characterized by a soleplate 12, a first plastic housing member 14 mounted on the soleplate 12 by suitable fastening means such as fastener 16 (FIG. 2) and having a peripheral skirt portion 18, a second main plastic housing member 20 mounted on the first housing member 14, and a third plastic member 22 defining the top wall of a handle 24 defined in part by the second housing member 20. As will be discussed in greater detail hereinafter and as best shown in FIG. 1, a spray button 26, an instant extra steam button 28, a temperature setting control lever 30, and a steam/dry control knob 32 are all located adjacent the forward portion of the handle 24 for maximum convenience of thumb actuation without release or change of one's normal grip of the handle 24 during ironing.

Figure 2:
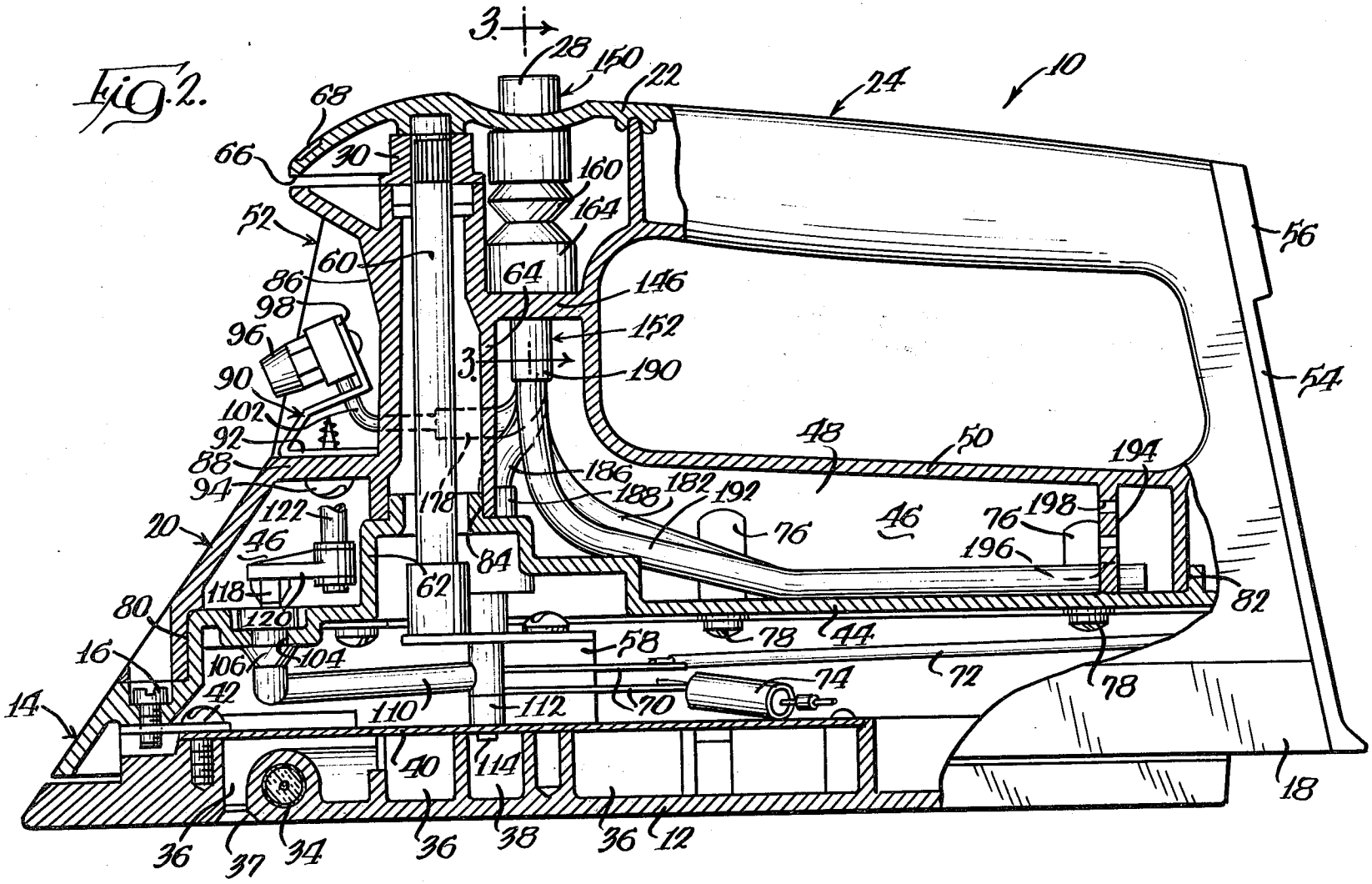
FIG. 2 is an enlarged scale side elevational view partially in vertical section as viewed generally along line 2—2 of FIG. 1.

As best shown in FIG. 2, the soleplate 12 has a heating element 34 provided therein as well as an opentop labyrinth of steam passages 36 including a first steam generator 38 and a plurality of steam vents 37 (only one of which is shown) in the bottom surface of the soleplate 12 which communicate with said steam passage 36 in a manner well known in the art. The open top of the steam passages 36 is closed by a cover plate 40 which is secured to the soleplate 12 by suitable fastening means such as the fastener 42.

The portion of the first plastic housing member 14, which is preferably formed of a phenolic, disposed inwardly of the peripheral skirt portion 18 thereof defines a bottom wall 44 of a water reservoir 46. The side walls 48 and top wall 50 of the reservoir 46 are defined by the second plastic housing member 20, which is preferably formed of a thermal-plastic polyester. The second plastic housing member 20 also defines a tower-like structure 52 at the front end of the iron 10 and a portion of the handle 24 which extends rearwardly from the upper end of the tower-like structure 52. A plastic rear cover member 54, also preferably formed of a thermal-plastic polyester, is fastened by suitable means to the rear of the iron 10 and has a heel rest 56 provided at the upper end thereof.

In a manner well known in the art, an adjustable thermostat 58 is mounted on the cover plate 40 with a rotatable control rod 60 therefor extending upwardly through a centrally bored raised formation 62 formed in the bottom wall 44 of the reservoir and a vertical sleeve formation 64 formed in the tower-like structure 52. The temperature control lever 30 is connected to the upper end of the control rod 60 and is rotatable, to adjust the temperature setting of the thermostat 58, in a horizontal plane through an arc of approximately 180° on a slot 66 defined between the upper forward portions of the second plastic housing member 20 and the third plastic handle cover member 22. Suitable temperature indicia is provided at 68 on handle cover member 22. Also associated with the thermostat 58 are terminals 70, an electrical lead 72 and a fuse 74.

The first and second plastic housing members 14 and 20 are mechanically connected together by mounting bosses 76 formed on the second housing member 20 and fasteners 78 which extend through the bottom wall portion 44 of the first housing member 14. However, the two plastic housing members 14 and 20 defining the reservoir 46 are sealingly connected together around their entire peripheral meeting edges and at certain other locations by a suitable adhesive sealant, such as RTV. The sealing locations visible in FIG. 2 are at 80 at the front of the iron 10, at 82 at the rear thereof, and at 84 where the lower end of the sleeve structure 64 of the housing member 20 fits over the bored raised formation of the housing member 14.

A depression 86, defined in part by a part of the sleeve structure 64, is formed in the front of the tower-like structure 52 and includes a horizontally disposed shelf-like structure 88. An angular bracket 90 has a lower leg 92 secured on said shelf-like surface 88 by a fastener 94. A known type spray nozzle 96 is mounted on an upper leg 98 of said bracket 90 so that spray therefrom is directed forwardly and downwardly in front of the iron 10.

To fill the reservoir 46, the iron 10 is supported vertically on its heel rest 56 and water is poured into the depression 86 from which it passes through open passages 100 (FIG. 1) defined on opposite sides of the sleeve structure 64 directly into the reservoir 46. An inlet conduit 102 of the nozzle 96 extends inwardly of one of the passages 100 as will be discussed further hereinafter.

Figure 5:
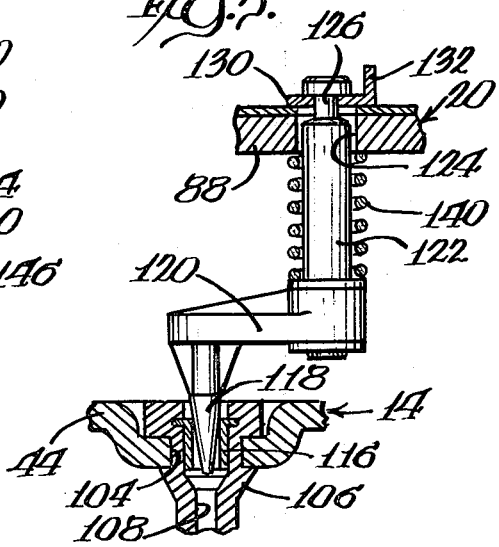
FIG. 5 is a partial vertical sectional view taken generally along line 5—5 of FIG. 4.

Although the lightweight iron 10 of the subject disclosure is primarily intended for use as a steam iron, occasions sometimes arise when it is necessary or desirable that the iron 10 be used for dry ironing. Therefore, a steam/dry control feature is provided. As is best illustrated in FIGS. 2 and 5, an offset opening 104 is provided in the front of the reservoir bottom wall portion 44 of the first housing member 14 with a valve seat assembly 106 sealingly mounted therein and having a central bore 108 formed therein which is connected to a generally horizontally disposed conduit 110 which in turn is connected to a vertically disposed conduit 112 having a sized outlet 114 at its lower end for discharging water from the reservoir 46 at a measured rate into the steam generator 38 whereby to normally provide a continuous gentle discharge of steam from the soleplate steam vents 37.

Figure 4:
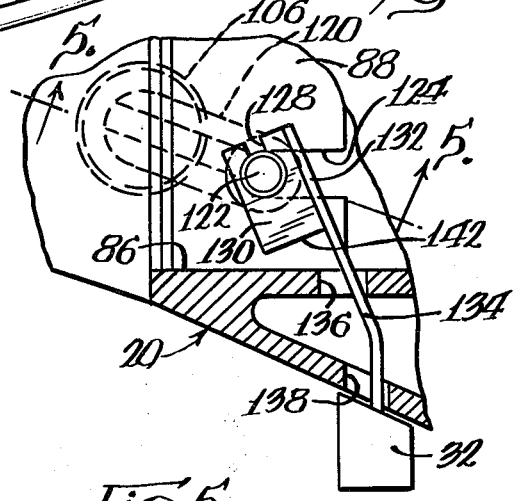
FIG. 4 is an enlarged scale partial horizontal sectional view taken generally along line 4—4 of FIG. 1.

However, to provide the option of dry ironing, a valve seat 116 is provided in the upper end of the valve seat assembly bore 108 and a conical valve pilot 118 is provided for selective engagement therewith to prevent the passage of water from the reservoir 46 into the steam generator 38. The valve pilot 118 depends from a radial arm 120 carried on the lower end of a vertically disposed valve stem 122 which extends upwardly through an opening 124 provided in the shelf-like surface 88. The upper end of the valve stem 122 is provided with a reduced-in-diameter neck portion 126 which is engaged in a slot 128 (FIG. 4) formed in a rectangular flat plate member 130 which extends across the opening 124. The plate member 130 has an upwardly bent edge 132 which is provided with a lever-like extension 134 which extends outwardly through openings 136 and 138 formed in an upper portion of the side wall structure of the housing member 20 not forming a part of the reservoir 46 with the steam/dry knob 32 mounted on the outer end thereof. A spring 140 disposed about the valve stem 122 between the shelf-like surface 88 and the radial arm 120 biases the valve pilot 118 downwardly into its downwardly into its valve-closing or dry ironing position. However, manual downward force applied to the knob 32 pivots the flat plate 130 about its edge 142 whereby to raise the valve stem 122, the radial arm 120, and the valve pilot 118 out of engagement with the valve seat 116 so as to permit normal steam iron operation. The opening 138 is J-shaped so that the lever 134 is swingable forward or to the left (as viewed in FIG. 1) to trap the lever 134 in the short leg of the J-shaped slot 138 during steam iron operation. The width of the opening 136 and the nature of the connection of the flat plate 130 to the valve stem 122 permits the foregoing forward movement of the lever 134 in the J-shaped opening 138. Suitable right-angled double arrowheaded indicia 144 (FIG. 1) is provided on the housing member 20 adjacent the steam/dry knob 32.

Figure 3:
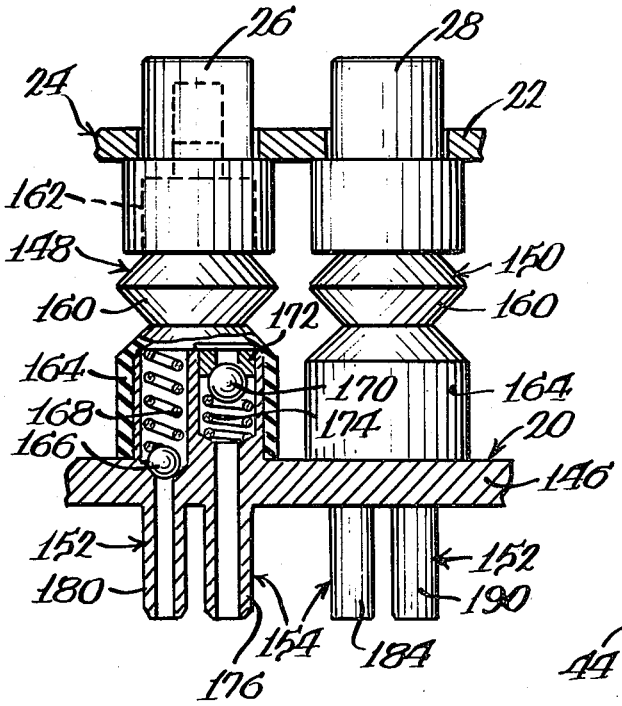
FIG. 3 is a further enlarged scale partial vertical sectional view taken generally along line 3—3 of FIG. 2.

As best shown in FIGS. 2 and 3, the second housing member 20 is characterized by a horizontally disposed wall portion 146 rearwardly of the sleeve structure 64 adapted to accommodate bellows pumps 148 and 150, the wall portion 146 being provided for each pump with centrally bored inlet and outlet nipples 152 and 154, respectively, which each project above and below the wall portion 146. As illustrated in FIG. 3, the pump 148 providing a spray feature and the pump 150 providing an instant extra steam feature are positioned side by side with the actuating buttons 26 and 28 therefor projecting upwardly through the handle cover member 22 at the forward end thereof for maximum convenience for the one ironing. As best shown in FIG. 3, each bellows pump 148, 150, which is formed of a rubber-like material, is characterized by a central bellows portion 160, by an upper portion 162 upon which the activating buttons 26, 28 are fitted, and by a lower sleeve-like portion 164 which is fitted over the upwardly projecting portions of the inlet and outlet nipples 152,154. The upper bore portion of each inlet nipple 152 has a ball check valve 166 biased downwardly into a normally closed position by a spring 168 and the upper bore portion of each outlet nipple 154 has a ball check valve 170 which is biased upwardly into a normally closed position against a valve seat 172 by a spring 174.

As is best illustrated in FIG. 2, the depending portion 176 of the outlet nipple or port 154 of the bellows pump 148 providing the spray feature is connected by a tube 178 to the inlet conduit 102 of the spray nozzle 96 and the depending portion 180 of the inlet nipple or port 152 of the bellows pump 148 providing the spray feature is connected to an inlet tube 182 which extends into the lower rear portion of the reservoir 46. Also, the depending portion 184 of the outlet nipple or port 154 of the bellows pump 150 providing the instant extra steam feature is connected by a tube 186 to an upwardly projecting bored boss 188 provided on the bottom wall portion 44 of the housing member 14 which leads to a second steam generator provided in the soleplate 12 which is not visible in FIG. 2 as same is located behind the steam generator 38. Actuation of the instant extra steam bellows pump 150 therefore pumps water from the reservoir 46 into this second steam generator to provide instant extra steam from the soleplate steam vents 37 when needed for particular ironing situations in a manner well known in the art. This instant extra steam feature also serves a second purpose of self-cleaning of the soleplate steam vents 37. The depending portion 190 of the inlet nipple or port 152 of the bellows pump 150 providing the instant extra steam feature is connected to an inlet tube 192 which also extends into the lower rear portion of the reservoir 46 alongside the inlet tube 182. The rearward ends of the inlet tubes 182 and 192 are retained in position in the lower rear portion of the reservoir 46 by a tube loom 194 (FIG. 2) which depends integrally from the top wall 50 of the reservoir 46 and has a pair of semi-circular recesses 196 provided in its bottom edge for retaining engagement with the rearward ends of the inlet tubes 182 and 192. With the ends of the inlet tubes 182 and 192 retained in the lower rear portion of the reservoir 46, the spray and instant extra steam features are usable not only when the iron 10 is in its normal horizontal position but also when the iron 10 is in a vertical position to permit full feature ironing of hanging fabrics such as curtains and drapes. The tube loom 194 is perforated, as at 198, to insure that the water level in the reservoir 46 is the same both forwardly and rearwardly of the tube loom 194.

As it could be desirable to provide a steam iron having only a spray feature or only an instant extra steam feature, it is noted that minor changes to the handle cover member 22 and the pump support wall 146 whereby to accommodate a single bellows pump is contemplated and possible within the scope of the present invention.

As shown in FIG. 1, a water level gauge 200 formed of a clear polycarbonate is sealingly mounted in a suitable elongated opening formed in the plastic housing member 20 and has a level indicator 202 associated therewith.

While there have been shown and/or described several alternative embodiments of the present invention, it will be apparent to those skilled in the art that various changes and modifications may be made without departing from the invention in its broader aspects and it is, therefore, contemplated in the appended claims to cover all such additions, changes and modifications that fall within the true spirit and scope of the present invention.

What is claimed as new and desired to be secured by Letters Patent of the United States is:

1. A lightweight pressing and steaming iron comprising a soleplate having a heating element provided therein as well as steam passages in communication with steam ports provided in said soleplate, a first plastic housing member mounted on said soleplate and defining the bottom wall of a water reservoir, a second plastic housing member disposed over and secured to said first plastic housing member by a suitable sealant and defining the top and side walls of said water reservoir, said second plastic housing member also defining a tower-like structure at the forward end of the iron and a handle projecting rearwardly from the upper end of said tower, valve means between said water reservoir and said soleplate steam passages including an orifice adapted, when said valve means is open, to provide a predetermined flow of water from said reservoir to said steam passages for normal steam ironing, first and second bellows pumps provided in the upper part of said tower in side by side relationship with the actuating portions thereof projecting upwardly through said handle at the forward end thereof, a spray nozzle on the front of said tower, the outlet port of said first bellows pump being connected to said spray nozzle, the outlet port of said second bellows pump being connected to said steam passages in said soleplate, and the inlet ports of both bellows pumps having inlet tubes extending into the lower rear portion of said reservoir whereby to provide, upon actuation of said first and second pumps, a fine spray from said nozzle and instant extra steam from said steam ports, respectively, with the iron disposed in either a horizontal or a vertical position.

2. The lightweight pressing and steaming iron of claim 1 wherein said valve means has a valve member biased into a closed position and wherein a lever associated with said valve member projects through an opening provided in a portion of the side of said second plastic housing not defining the water reservoir to permit manual opening movement of said valve member and, therefore, use of the iron as both a dry and steam iron.

3. The lightweight pressing and steam iron of claim 1 wherein a tube loom is provided for engaging and retaining the rear ends of said inlet tubes in the lower rear portion of said reservoir.

4. A lightweight pressing and steaming iron comprising a soleplate having a heating element provided therein as well as steam passages in communication with steam ports provided in said soleplate, a first plastic housing member mounted on said soleplate and defining the bottom wall of a water reservoir, a second plastic housing member disposed over and secured to said first plastic housing member by a suitable sealant and defining the top and side walls of said water reservoir, said second plastic housing member also defining a tower-like structure at the forward end of the iron and a handle projecting rearwardly from the upper end of said tower, valve means between said water reservoir and said soleplate steam passages including an orifice adapted, when said valve means is open, to provide a predetermined flow of water from said reservoir to said steam passages for normal steam ironing, a bellows pump provided in the upper part of said tower with the actuating portion thereof projecting upwardly through said handle at the forward end thereof, the outlet port of said bellows pump being connected to said steam passages in said soleplate, and the inlet port of said bellows pump having an inlet tube extending into the lower rear portion of said reservoir whereby to provide, upon actuation of said pump, instant extra steam from said steam ports with the iron disposed in either a horizontal or a vertical position.

5. The lightweight pressing and steam iron of claim 4 wherein a tube loom is provided for engaging and retaining the rear end of said inlet tube in the lower rear portion of said reservoir.

6. The lightweight pressing and steaming iron of claim 4 wherein a spray nozzle is mounted on the front of said tower, and wherein a second bellows pump is mounted in said tower alongside said first-named bellows pump with its outlet port connected to said spray nozzle and with an inlet tube extending from its inlet port into the lower rear portion of said reservoir whereby to provide a fine spray from said nozzle upon actuation of said second pump with the iron disposed in either a horizontal or a vertical position.

7. The lightweight pressing and steam iron of claim 6 wherein a tube loom is provided for engaging and retaining the rear ends of said inlet tubes in the lower rear portion of said reservoir.

8. A lightweight pressing and steaming iron comprising a soleplate having a heating element provided therein as well as steam passages in communication with steam ports provided in said soleplate, a first plastic housing member mounted on said soleplate and defining the bottom wall of a water reservoir, a second plastic housing member disposed over and secured to said first plastic housing member by a suitable sealant and defining the top and side walls of said water reservoir, said second plastic housing member also defining a tower-like structure at the forward end of the iron and a handle projecting rearwardly from the upper end of said tower, valve means between said water reservoir and said soleplate steam passages including an orifice adapted, when said valve means is open, to provide a predetermined flow of water from said reservoir to said steam passages for normal steam ironing, a bellows pump provided in the upper part of said tower-like structure with the actuating portion thereof projecting upwardly through said handle at the forward end thereof, a spray nozzle mounted on the front of said tower-like structure, the outlet port of said bellows pump being connected to said spray nozzle, and the inlet port of said bellows pump having an inlet tube extending into the lower rear portion of said reservoir whereby to provide, upon actuation of said pump, a fine spray from said nozzle with the iron disposed in either a horizontal or a vertical position.

9. The lightweight pressing and steam iron of claim 8 wherein a tube loom is provided for engaging and retaining the rear end of said inlet tube in the lower rear portion of said reservoir.

10. The lightweight pressing and steam iron of claim 8 wherein a second bellows pump is mounted in said tower-like structure alongside said first-named bellows pump with its outlet port connected to said soleplate steam passages and with an inlet tube extending from its inlet port into the lower rear portion of said reservoir whereby to provide, upon actuation of said second pump, instant extra steam from said steam ports with the iron disposed in either a horizontal or a vertical position.

11. The lightweight pressing and steam iron of claim 10 wherein a tube loom is provided for engaging and retaining the rear ends of said inlet tubes in the lower rear portion of said reservoir.

* * * * *